US006520437B2

(12) United States Patent
Jean

(10) Patent No.: US 6,520,437 B2
(45) Date of Patent: Feb. 18, 2003

(54) CONICAL CRUSHING BOARD AND SPINDLE MOUNTING ARRANGEMENT FOR A CONE CRUSHER

(76) Inventor: Cheng-Shu Jean, No. 14, Chung Hsing N. St., Sanchung City, Taipei Hsien (TW)

( * ) Notice: Subject to any disclaimer, the term of this patent is extended or adjusted under 35 U.S.C. 154(b) by 64 days.

(21) Appl. No.: 09/854,531

(22) Filed: May 15, 2001

(65) Prior Publication Data

US 2002/0170995 A1 Nov. 21, 2002

(51) Int. Cl.[7] ..... B02C 2/00

(52) U.S. Cl. ..... 241/207

(58) Field of Search ..... 241/207–216

(56) References Cited

U.S. PATENT DOCUMENTS 4,750,681 A * 6/1988 Sawant et al. ..... 241/208

* cited by examiner

*Primary Examiner*—Mark Rosenbaum
(74) *Attorney, Agent, or Firm*—Rosenberg, Klein & Lee

(57) ABSTRACT

A conical crushing board and spindle mounting arrangement, which includes a cone fixedly mounted on a spindle, a conical crushing board mounted on the cone, the conical crushing board having a series of sloping teeth at a top side thereof, a conical locating member mounted on the conical crushing board around the spindle, the conical locating member being formed of four arched blocks abutted against one another and having a series of sloping teeth at a bottom side thereof respectively meshed with the sloping teeth at the conical crushing board, a lock nut fastened to the spindle to hold down the conical locating member and the conical crushing board, and a plurality of keys respectively inserted into respective radial locating grooves at the lock nut and engaged into respective locating notches at the conical locating member.

1 Claim, 8 Drawing Sheets

CONICAL CRUSHING BOARD AND SPINDLE MOUNTING ARRANGEMENT FOR A CONE CRUSHER

BACKGROUND OF THE INVENTION

The present invention relates to a cone crusher, and more specifically to the arrangement of a conical crushing board and a spindle in a cone crusher, which enables the conical crushing board to be quickly replaced without causing a damage to the spindle and the conical locating member fixing lock nut.

The brochure attached herein shows a cone crusher invented by the present inventor. The cone crusher comprises a spindle, and a conical crushing board mounted on the spindle for a synchronous gyratory motion with the spindle relative to a fixed conical board in the housing of the cone crush. When stones are put in the cone crusher in between the conical crushing board and the fixed conical board, they are crushed during rotation of the cone crusher. Because the conical crushing board and the fixed conical board wear quickly with use, they must be replaced a certain length of time after use.

FIG. 1 shows a conical crushing board and spindle mounting arrangement for a cone crusher according to the prior art. This conical crushing board and spindle mounting arrangement comprises a spindle 1, a cone 2 mounted on the spindle 1, a conical crushing board 3 mounted on the cone 2, the conical crushing board 3 having a plurality of radially extended U-grooves 31 at a top side thereof (see FIG. 1A), a conical locating member 4 mounted on the conical crushing board 3 around the spindle 1, the conical locating member 4 having two axially extended through holes 41 and a plurality of radially extended U-grooves 42 at a bottom side thereof corresponding to the U-grooves 31 at the conical crushing board 3 (see FIGS. 1B and 1C), a plurality of locating pins 43 respectively inserted into the U-grooves 31 at the conical crushing board 3 and the U-groove 42 at the conical locating member 4 to stop the conical locating member 4 from rotary motion relative to the conical crushing board 3 (see FIGS. 1 and 1A), and a lock nut 5 threaded onto the spindle 1 to hold down the conical locating member 4. The lock nut 5 has two through holes 51 respectively connected to the through holes 41 at the conical locating member 4 by a respective locating pin 52. When the conical crushing board 3 is rotated with the spindle 1, the conical locating member 4 and the lock nut 5 are synchronously rotated. When the lock nut 5 is rotated with the conical locating member 4, the connection between the lock nut 5 and the spindle 1 is further tightened. After a long use of the cone crusher, it is difficult to disconnect the lock nut 5 and the conical locating member 4 from the spindle 1 and the conical crushing board 3. When replacing the conical crushing board 3, the conical locating member 4 must be cut with a cutting torch or the like, enabling the lock nut 5 to be knocked away from the locking position with a hammer. When knocking the lock nut 5 away from the locking position, the inner thread of the lock nut 5 tends to be damaged. If directly cutting the lock nut 5 with a cutting torch or the like, the outer thread 11 of the spindle 1 tends to be damaged. If the inner thread of the lock nut 5 or the outer thread 11 of the spindle 1 is damaged, the lock nut 5 or the spindle 1 becomes useless. It is expensive to replace the lock nut 5 and the spindle 1.

SUMMARY OF THE INVENTION

The present invention has been accomplished to provide a conical crushing board and spindle mounting arrangement for a cone crusher, which eliminates the aforesaid drawbacks. According to one aspect of the present invention, the conical crushing board and spindle mounting arrangement comprises a cone fixedly mounted on a spindle, a conical crushing board mounted on the cone, the conical crushing board having a series of sloping teeth at a top side thereof, a conical locating member mounted on the conical crushing board around the spindle, the conical locating member being formed of four arched blocks abutted against one another and having a series of sloping teeth at a bottom side thereof respectively meshed with the sloping teeth at the conical crushing board, a lock nut fastened to the spindle to hold down the conical locating member and the conical crushing board, and a plurality of keys respectively inserted into respective radial locating grooves at the lock nut and engaged into respective locating notches at the conical locating member. According to another aspect of the present invention, the conical locating member has a thin wall portion through which the conical locating member can be cut with a cutting torch, so that the arched blocks of the conical locating member can be disconnected from one another and removed from the spindle, enabling the conical crushing board to be removed from the spindle for a replacement after a long use.

BRIEF DESCRIPTION OF THE DRAWINGS

FIG. 2B is a sectional view in an enlarged scale taken along line F—F of FIG. 2.

DETAILED DESCRIPTION OF THE PREFERRED EMBODIMENT

Figure 1A:
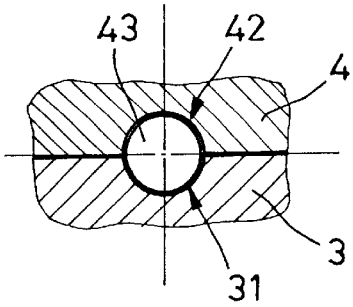
FIG. 1A is a sectional view in an enlarged scale of a part of FIG. 1.
Figure 1:
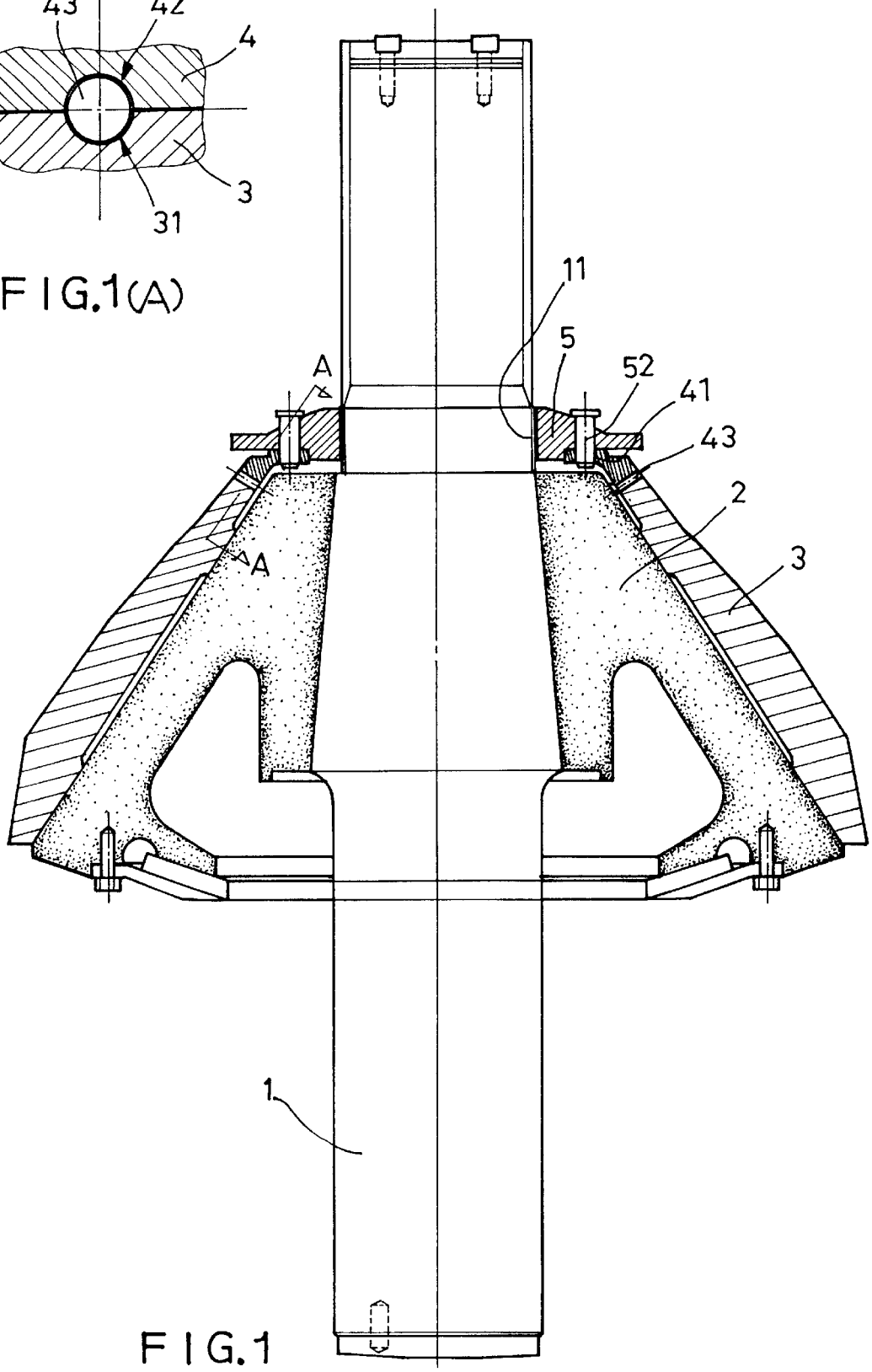
FIG. 1 is a sectional view showing a conical crushing board and spindle mounting arrangement for a cone crusher according to the prior art.
Figure 1B:
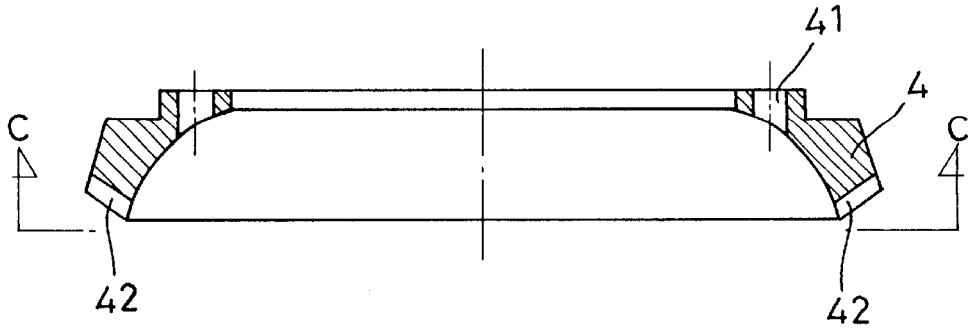
FIG. 1B is a side view in section of the conical locating member shown in FIG. 1.
Figure 1C:
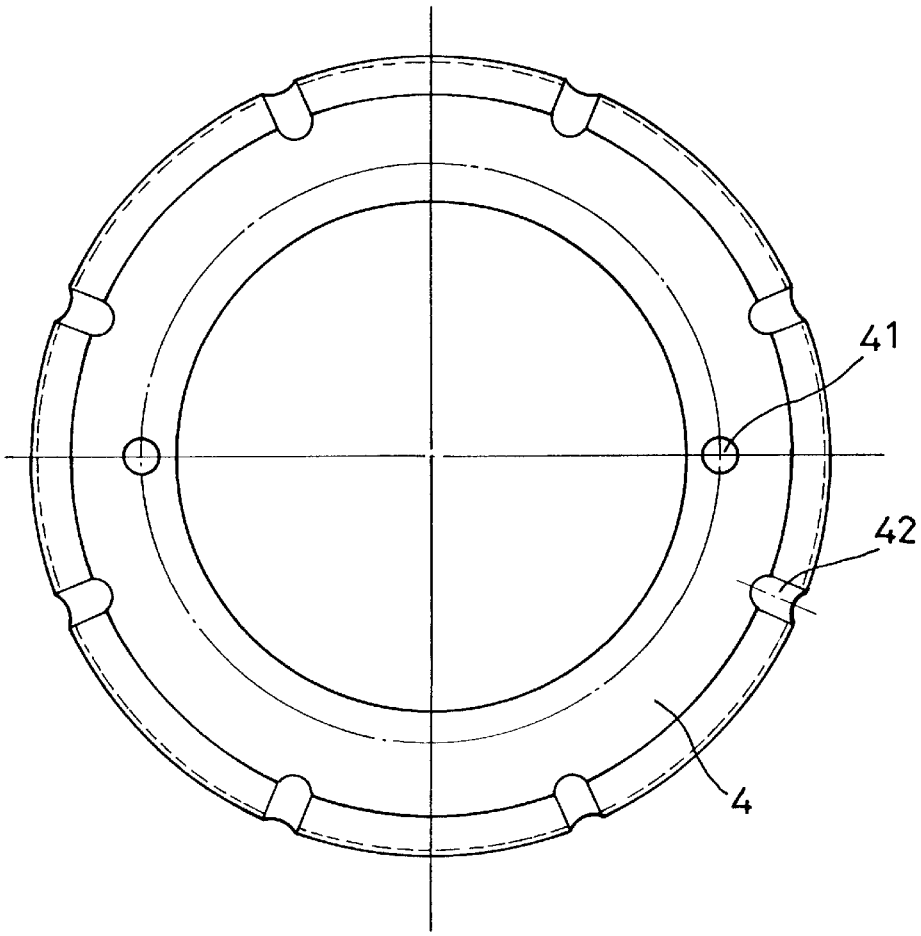
FIG. 1C is a top plain view of the conical locating member shown in FIG. 1B.
Figure 1D:
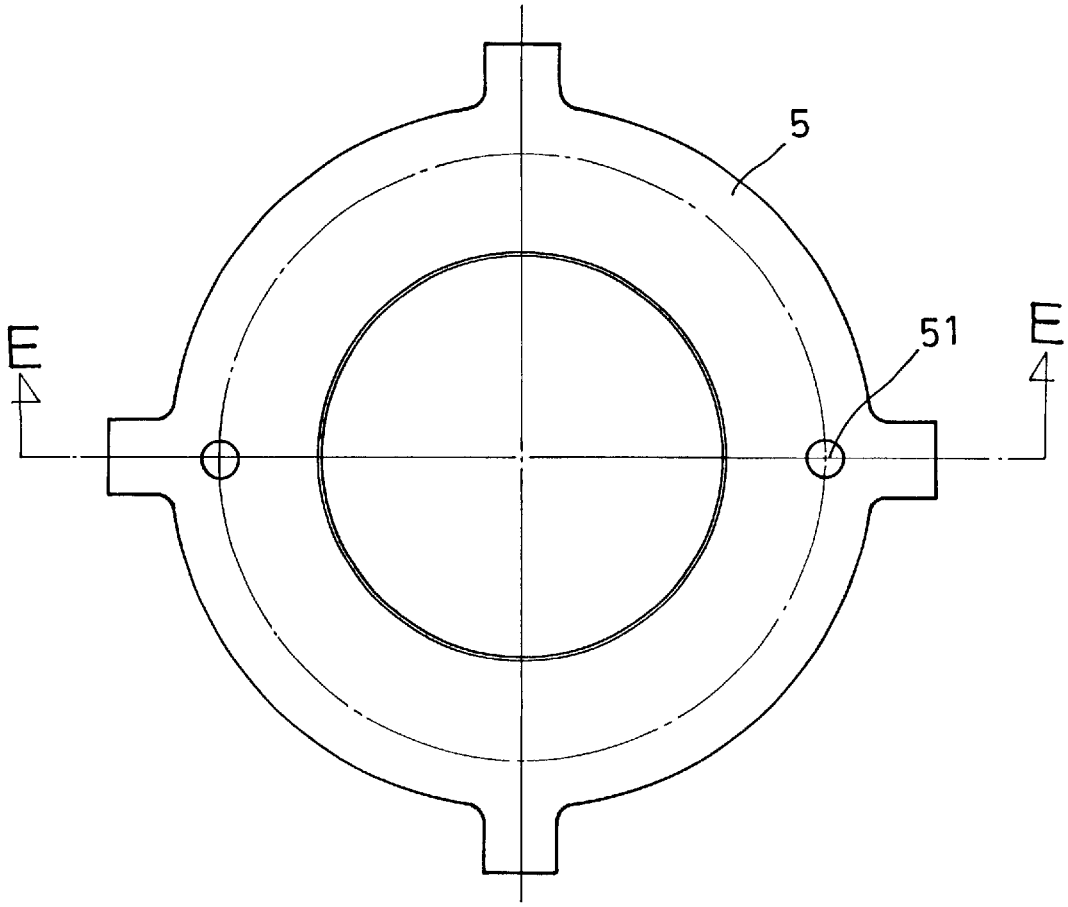
FIG. 1D is a top plain view of the lock nut shown in FIG. 1.
Figure 1E:
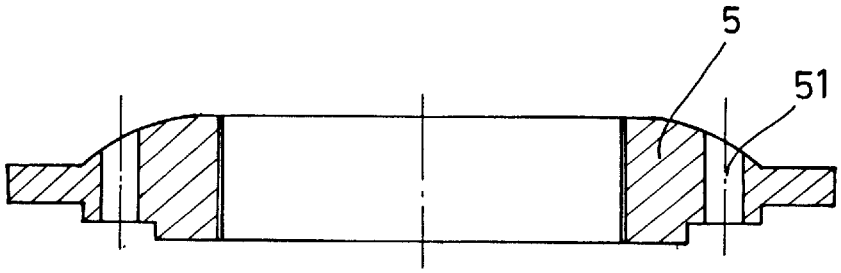
FIG. 1E is a side view in section of the lock nut shown in FIG. 1D.
Figure 2:
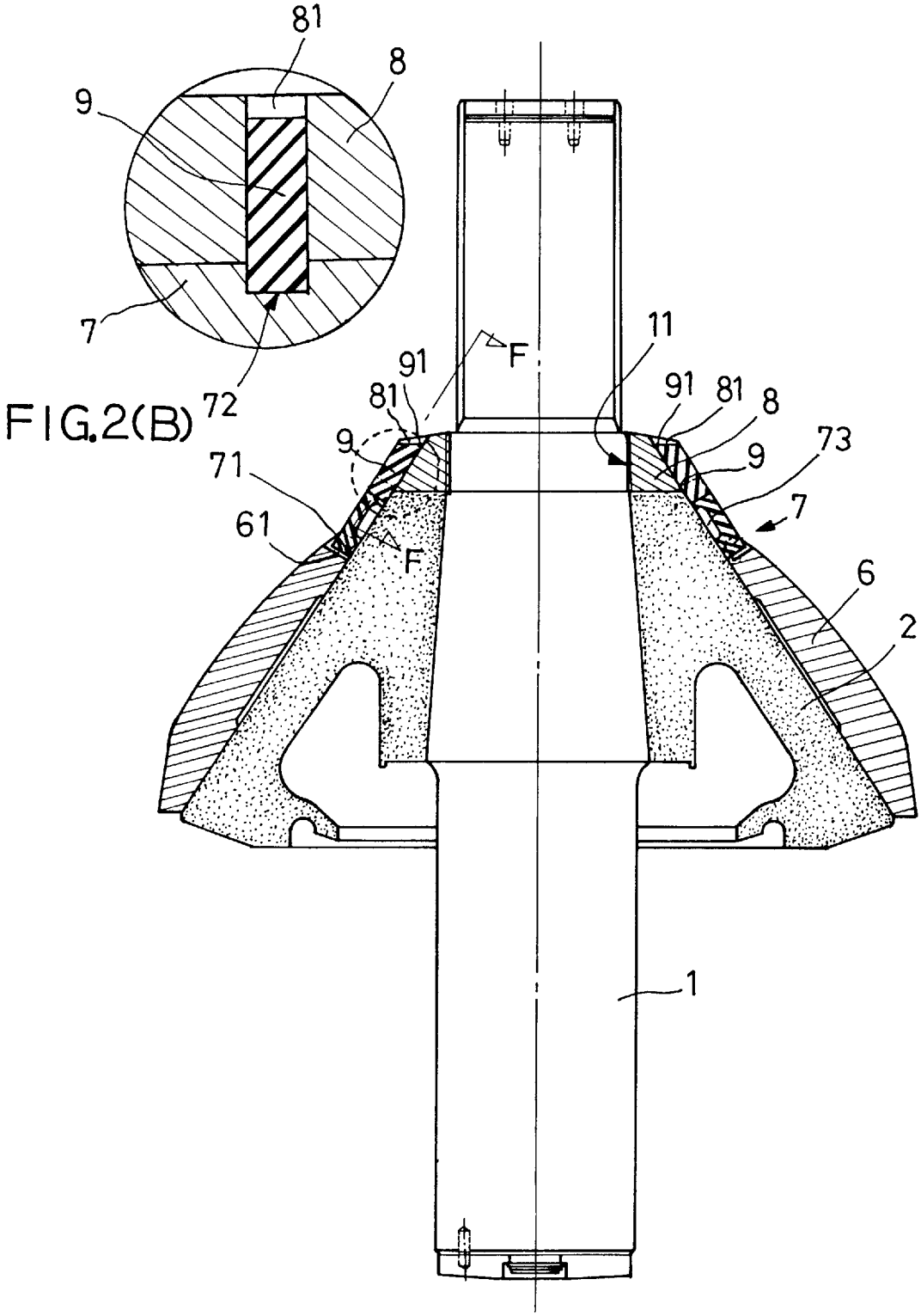
FIG. 2 is a sectional view of a conical crushing board and spindle mounting arrangement for a cone crusher according to the present invention.
Figure 3:
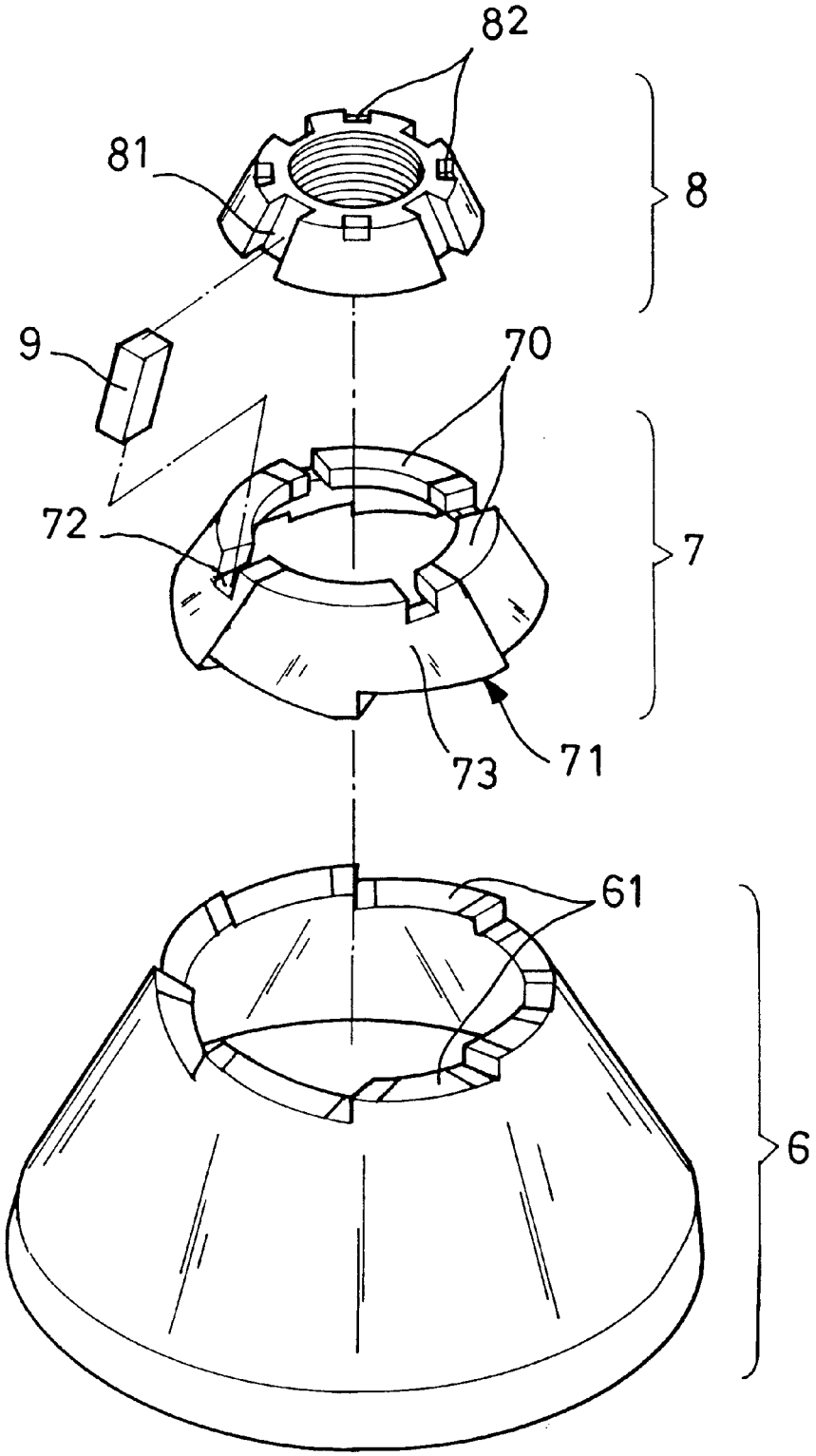
FIG. 3 is an exploded view of the present invention (the spindle and the cone excluded).
Figure 4:
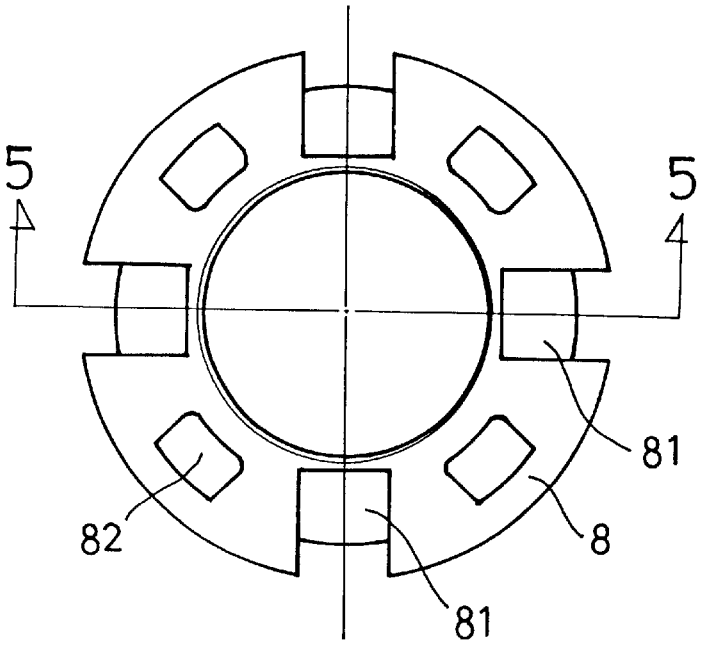
FIG. 4 is a top plain view in an enlarged scale of the lock nut shown in FIG. 3.
Figure 5:
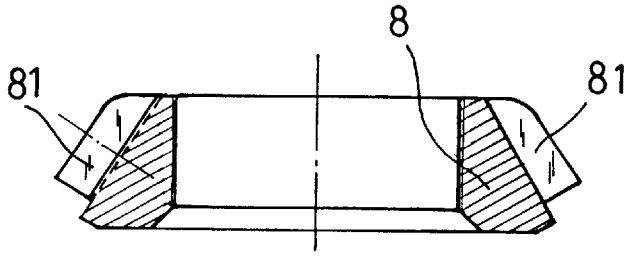
FIG. 5 is a side view in section of FIG. 4.
Figure 6:
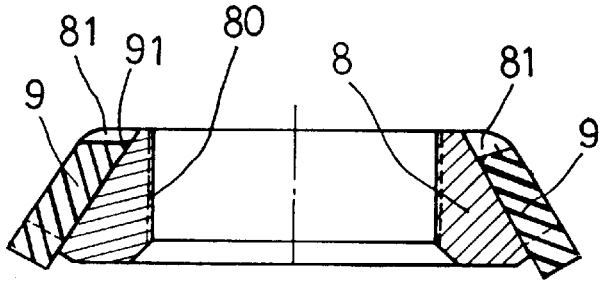
FIG. 6 is similar to FIG. 5 but showing locating keys mounted in the locating grooves at the lock nut.
Figure 7:
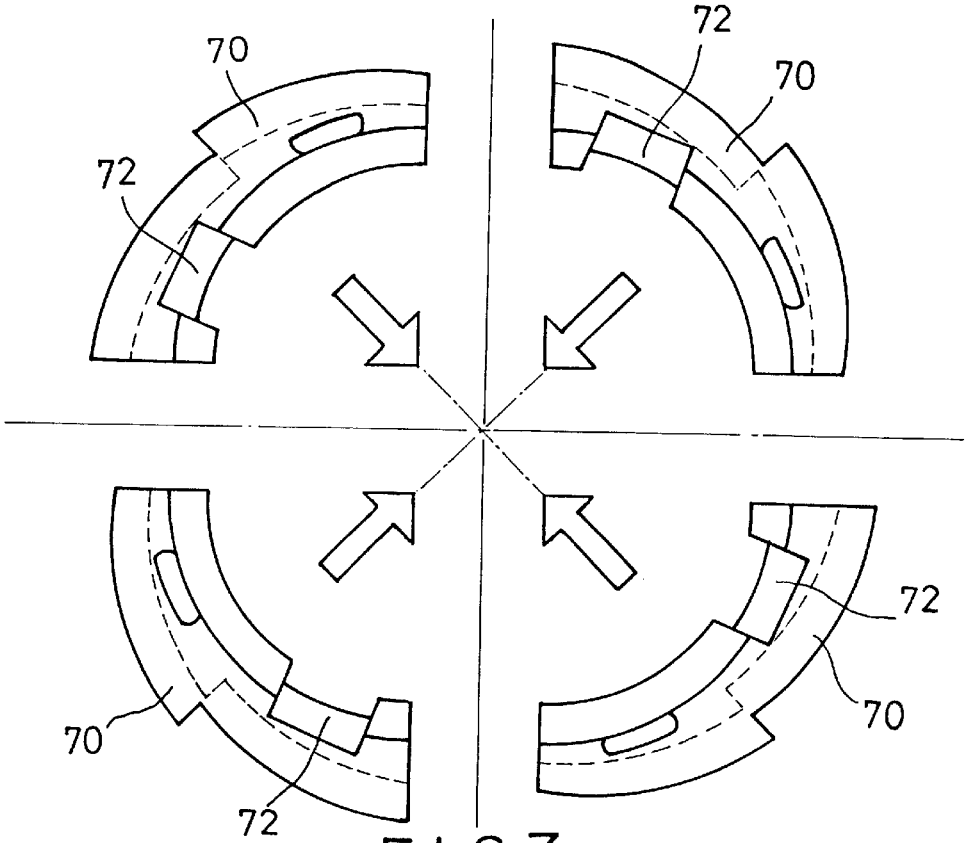
FIG. 7 is an exploded top plain view in an enlarged scale of the conical locating member shown in FIG. 3.
Figure 8:
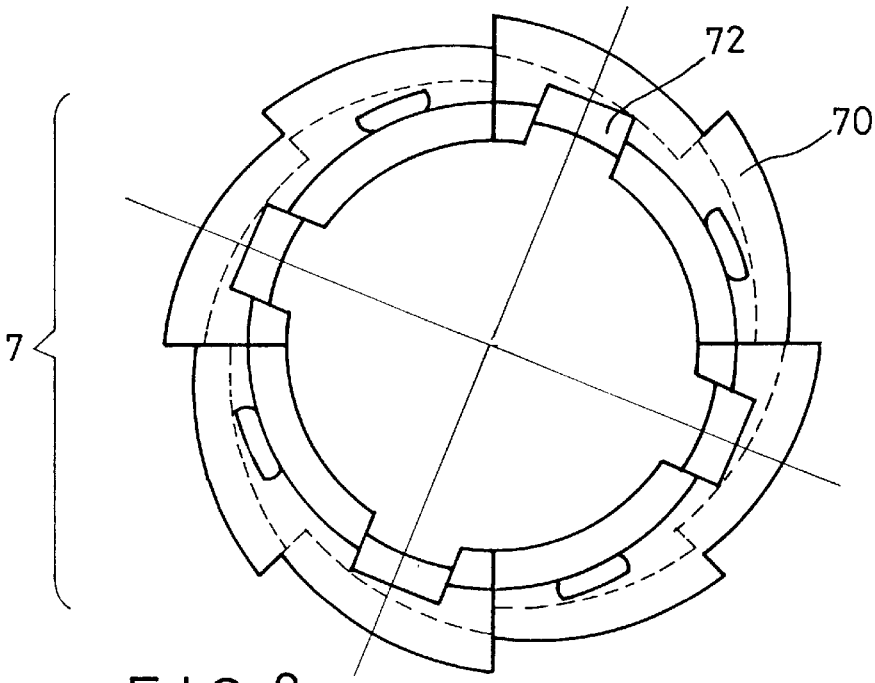
FIG. 8 is a top plain view of the conical locating member shown in FIG. 3 when assembled.
Figure 9:
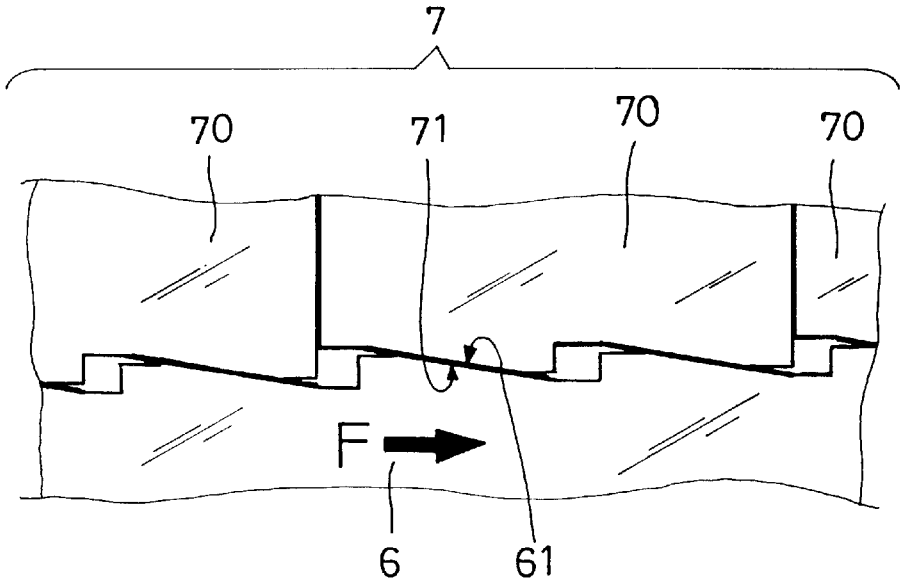
FIG. 9 is a side plain view in an enlarged scale of a part of the present invention, showing the conical locating member and the conical crushing board meshed together.

Referring to FIGS. 2 through 9, a conical crushing board and spindle mounting arrangement in accordance with the present invention is shown comprised of a spindle 1, a cone 2 fixedly mounted on the spindle 1, a conical crushing board 6 mounted on the cone 2, a conical locating member 7 mounted on the conical crushing board 6 around the spindle 1, a lock nut 8 fastened to the spindle 1 to hold down the conical locating member 7 and the conical crushing board 6, and a plurality of keys 9 respectively welded to the lock nut 8 to hold down the conical locating member 7.

The conical crushing board 6 comprises a series of sloping teeth 61 formed integral with the topmost edge thereof. The sloping teeth 61 slope in one direction, and connected one after another. The conical locating member 7 is comprised of four arched blocks 70 abutted against one another, having a plurality of sloping teeth 71 equiangularly spaced at the bottom side thereof for engagement with the sloping teeth 61 at the conical crushing board 6, a plurality of locating notches 72 equiangularly spaced at the top side thereof, and a thin wall portion 73. The lock nut 8 comprises a plurality of radial locating grooves 81 equiangularly spaced around the periphery and extended to top and bottom sides thereof corresponding to the locating notches 72 at the conical locating member 7, and a plurality of locating notches 82 equiangularly spaced at the topmost edge thereof. The keys 9 are respectively inserted into the radial locating grooves 81 at the lock nut 8, and partially engaged into the locating notches 72 at the conical locating member 7 to connect the lock nut 8 and the conical locating member 7 together.

After installation of the conical crushing board 6 on the cone 2 at the spindle 1 and the conical locating member 7 on the conical crushing board 6, the lock nut 8 is threaded onto the outer thread 11 at the spindle 1 to hold down the conical locating member 7 and the conical crushing board 6. The keys 9 are respectively inserted into the radial locating grooves 81 at the lock nut 8, and then the inserted part 91 of each key 9 is respectively welded to the lock nut 8. The inner thread 80 of the lock nut 8 is produced after welding of the keys 9. Therefore, welding the keys 9 to the lock nut 8 does not cause a deformation of the inner thread 80. After installation of the lock nut 8, the conical crushing board 6 is sleeved onto the cone 2. Because the smallest inner diameter of the conical crushing board 6 is greater than the outer diameter of the lock nut 8, the conical crushing board 6 can easily be moved over the lock nut 8 and sleeved onto the cone 2. Thereafter, the four arched blocks 70 of the conical locating member 7 are abutted against one another and forced into engagement with the sloping teeth 61 at the conical crushing board 6, enabling the locating notches 72 of the conical locating member 7 to be respectively coupled to the bottom end of each of the keys 9. When the conical crushing board 6 is rotated with the spindle 1, crushed stones impart a reactive force F to the conical crushing board 6, thereby causing the conical crushing board 6 to displace on the cone 2 (see FIG. 9). However, because the sloping teeth 61 of the conical crushing board 6 are engaged with the sloping teeth 71 of the conical locating member 7, more pressure is given to the conical crushing board 6 when the conical crushing board 6 is continuously rotated with the spindle 1, thereby causing the conical crushing board 6 to be firmly secured to the cone 2.

When the conical crushing board 6 starts to wear, the thin wall portion 73 of the conical locating member 7 is cut with a cutting torch, enabling the four arched blocks 70 of the conical locating member 7 to be separated from one another and removed from the spindle 1. After removal of the conical locating member 7, the conical crushing board 6 is lifted from the cone 2, and then a new conical crushing board 6 and a new conical locating member 7 are installed.

As indicated above, it is not necessary to disconnect the lock nut 8 from the spindle 1 when removing the conical locating member 7 from the spindle 1 for a replacement of the conical crushing board 6. Because the conical locating member 7 receives no sideways pressure but only an upward push force from the conical crushing board 6, the arched blocks 70 can be formed retained together without welding when abutted against one another and engaged with the conical crushing board 6.

Figure 10:
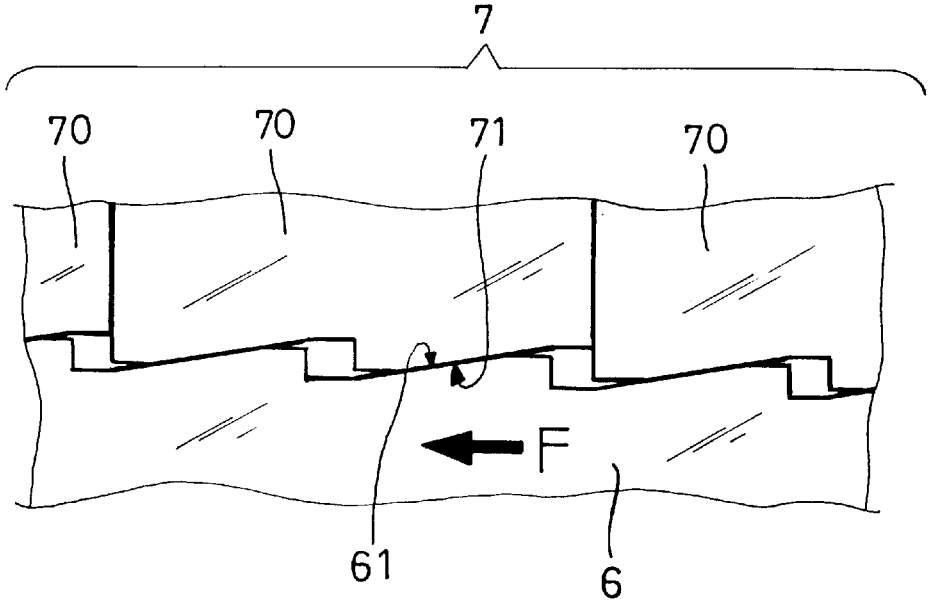
FIG. 10 shows an alternate form of the present invention.

FIG. 10 shows an alternate form of the present invention. According to this alternate form, the sloping direction of the sloping teeth 61 at the conical crushing board 6 and the sloping teeth 71 at the conical locating member 7 is reversed to the embodiment shown in FIGS. 1 through 9. The direction of the reactive force F received by the conical crushing board 6 of the embodiment shown in FIG. 10 is also reversed to the direction of the reactive force F received by the conical crushing board 6 of the embodiment shown in FIG. 9.

Because it is not necessary to disconnect the lock nut 8 from the spindle 1 when replacing the conical crushing board 6, the replacement of the conical crushing board 6 can easily and quickly performed without causing a damage to the spindle 1. Further, because the conical crushing board 6 is mounted on the cone 2 at the spindle 1 and meshed with the sloping teeth 71 of the conical locating member 7, the connection between the conical crushing board 6 and the cone 2 is reinforced with the use of the cone crusher.

It is to be understood that the drawings are designed for purposes of illustration only, and are not intended for use as a definition of the limits and scope of the invention disclosed.

What the invention claimed is:

1. A conical crushing board and spindle mounting arrangement comprised of a spindle, a cone fixedly mounted on said spindle, a conical crushing board mounted on said cone, a conical locating member mounted on said conical crushing board around said spindle, a lock nut fastened to said spindle to hold down said conical locating member and said conical crushing board, and a plurality of keys connected between said lock nut and said conical locating member, wherein:

said conical crushing board comprises a series of sloping teeth formed integral with the topmost edge thereof, the sloping teeth of said conical crushing board sloping in one direction and connected one after another;

said conical locating member is comprised of four arched blocks abutted against one another, having a plurality of sloping teeth equiangularly spaced at a bottom side thereof and engaged with the sloping teeth of said conical crushing board, a plurality of locating notches equiangularly spaced at a top side thereof, and a thin wall portion for cutting with a cutting torch when replacing said conical crushing board with a new conical crushing board;

said lock nut comprises a plurality of radial locating grooves equiangularly spaced around the periphery thereof and extended to top and bottom sides thereof corresponding to the locating notches at said conical locating member;

said keys are respectively inserted into the radial locating grooves at said lock nut, and partially engaged into the locating notches at said conical locating member.

* * * * *